United States Patent [19]

Jones

[11] 4,346,634

[45] Aug. 31, 1982

[54] CHOPPING AND SHREDDING DEVICE

[75] Inventor: Frank W. Jones, Greenville, Del.

[73] Assignee: Alco Foodservice Equipment Company, Wilmington, Del.

[21] Appl. No.: 186,119

[22] Filed: Sep. 11, 1980

[51] Int. Cl.[3] ..... B26D 3/26; B26D 4/18

[52] U.S. Cl. ..... 83/431; 83/404.3; 83/425.3; 83/437; 83/858; 83/733

[58] Field of Search ..... 83/431, 437, 425.3, 83/425.2, 404.3, 858, 733

[56] References Cited

U.S. PATENT DOCUMENTS

| | | | |
|---|---|---|---|
| 523,750 | 7/1894 | Odell | 83/437 |
| 3,033,255 | 5/1962 | Pitavy | 83/437 |
| 3,605,839 | 9/1971 | Gerson | 83/425.3 |
| 3,794,490 | 11/1973 | Gerson | 83/425.3 |
| 3,924,501 | 12/1975 | Cohen et al. | 83/404.3 |
| 4,144,784 | 3/1979 | Jones | 83/425.3 |

*Primary Examiner*—Donald R. Schran
*Attorney, Agent, or Firm*—Connolly and Hutz

[57] ABSTRACT

A set of blades is held in the blade-supporting section of a base frame connected to a mounting section, which attaches it to a table surface with the blades overhanging the surface. A pusher head having a number of fingers is pivotally connected to the mid-portion of a handle which is rotatably mounted on the frame. A tilting linkage is rotatably connected to the pusher and to the frame for disposing the pusher more directly through the blades at the end of its stroke than if the pusher were rigidly attached to the handle. The chopped pieces pass directly to the container in a free space below the blade section of the frame. Pairs of struts and tilting linkages balance and stabilize the operating action.

3 Claims, 9 Drawing Figures

10
12
16
24
25
26
27
28
29
30
31
32
34
39
40
42
43
44
45
46
47
49
50
51
53
56
58
59
62
63
67
5
6

CHOPPING AND SHREDDING DEVICE

BACKGROUND OF THE INVENTION

Devices suitable for chopping and shredding food objects such as heads of lettuce are described in U.S. Pat. No. 3,605,839, FIGS. 4–7 and U.S. Pat. No. 3,924,501. Such devices are mounted on a working table and a limited free space exists under them for receiving the chopped pieces. The vertical sliding action in U.S. Pat. No. 3,924,501 is awkward and subject to binding and the rotational action in U.S. Pat. No. 3,605,839 wastefully diverts a considerable component by pushing along the blades rather than directly through them. An object of this invention is to provide a device for shredding and chopping objects, which discharges clear of a mounting surface and operates with high force utilization.

SUMMARY

The pusher head of a chopping and shredding device is mounted on a mid-section of a rotatable handle connected to the frame. The blades are held in a portion of the frame in the path of movement of the pusher head. A tilting linkage reacting between the frame and the pusher head moves the pusher head more directly into the object when the handle is disposed away from the blades, and tilts the head to dispose fingers on the pusher more cleanly thru the blades than if the pusher head were more rigidly attached to the handle. The tilting linkage may include rotatable connections to the pusher head and the frame and may include a pair of linkages to balance its action. The operating handle also may include a pair of struts to apply more balanced force to the pusher head. A frame mounting section may secure the device to a working table surface with the blade section overhanging it to freely discharge the shredded and cut pieces into a lower container.

BRIEF DESCRIPTION OF THE DRAWINGS

Novel features and advantages of the present invention will become apparent to one skilled in the art from a reading of the following description in conjunction with the accompanying drawings wherein similar reference characters refer to similar parts and in which.

DESCRIPTION OF THE PREFERRED EMBODIMENTS

Figure 1:
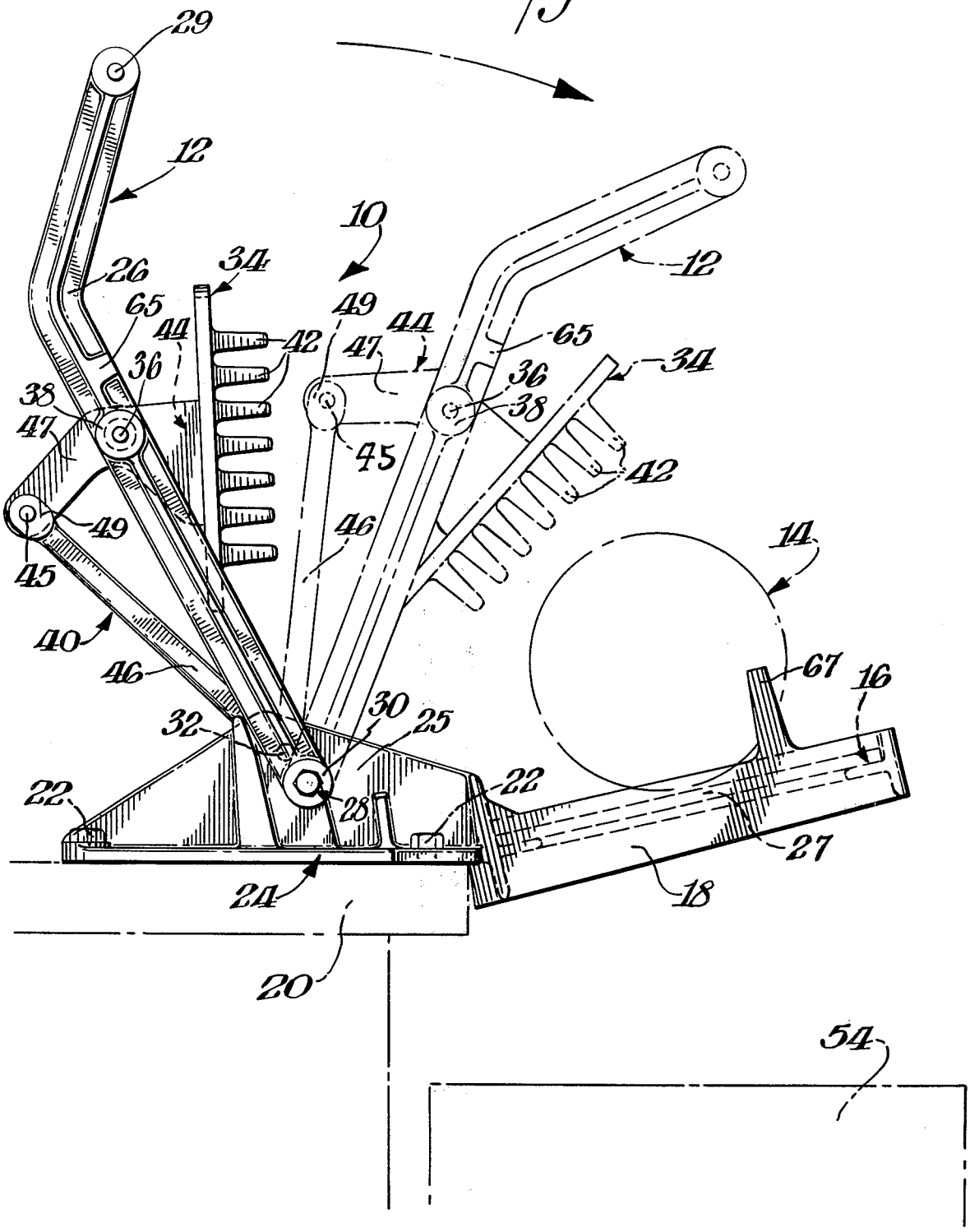
FIG. 1 is a side view in elevation of a chopping and shredding device, which is one embodiment of this invention with the fully raised operating handle assembly shown in full outline and an intermediate position shown in phantom outline with an object such as a head of lettuce, in position for chopping and shredding, also in phantom.
Figure 2:
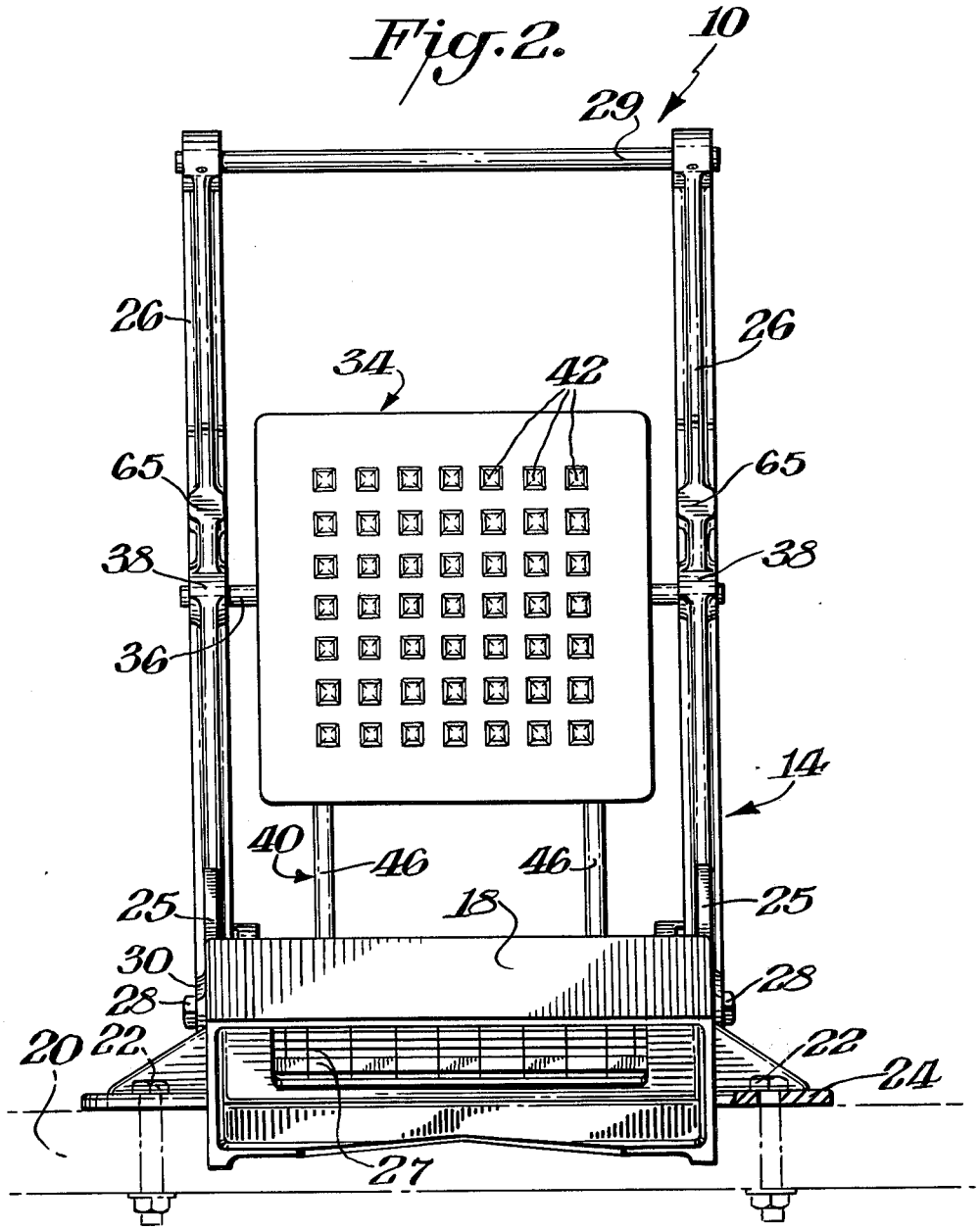
FIG. 2 is a front elevational view of the solid outline portions of the embodiment shown in FIG. 1.

In FIG. 1 is shown a chopping and shredding device 10 with handle 12 in the open position shown in full outline and an intermediate position shown in phantom outline. An object to be chopped, such as a head of lettuce 14, is shown in phantom outline on blade-supporting section 16 of frame 18, which is mounted on a working table surface 20 by fastening bolts 22 (FIGS. 1 and 2) through frame mounting section 24. Part of blades 26 are shown in hidden outline under lettuce head 14 as shown in FIGS. 1 and 2.

Handle 12 includes a pair of handle struts 26 rotatably connected to frame extensions 25 of frame 24 by rotational support means 28 and the bearing collars 30 at the lower ends of struts 26. A handle bar 29 is attached at the upper ends of handle struts 26. Handle struts 26 are rotatably connected to the outboard sides of the frame extensions 25 by support means 28 passing through the bearing collars 30 and attached to those frame extensions. The rotational support means 28 is a pivot shaft having a bolt head, a smooth shaft section and a threaded end section for attachment to frame extensions 25.

Pusher head 34 is pivotally connected between handle struts 26 by shaft 36 that extends through bearing collars 38 on struts 26 and through U-shaped lever bracket 44 attached to pusher head 34.

Tilting linkage 40 connects pusher head 34 to frame extensions 25 for movement in a manner later described. Elongated slightly tapered fingers 42 are mounted on a rectangular array on pusher head 34 for pushing the object 14 into and through the blades 26. The fingers 42 are accordingly positioned to pass through spaces provided between the blades.

Figure 3:
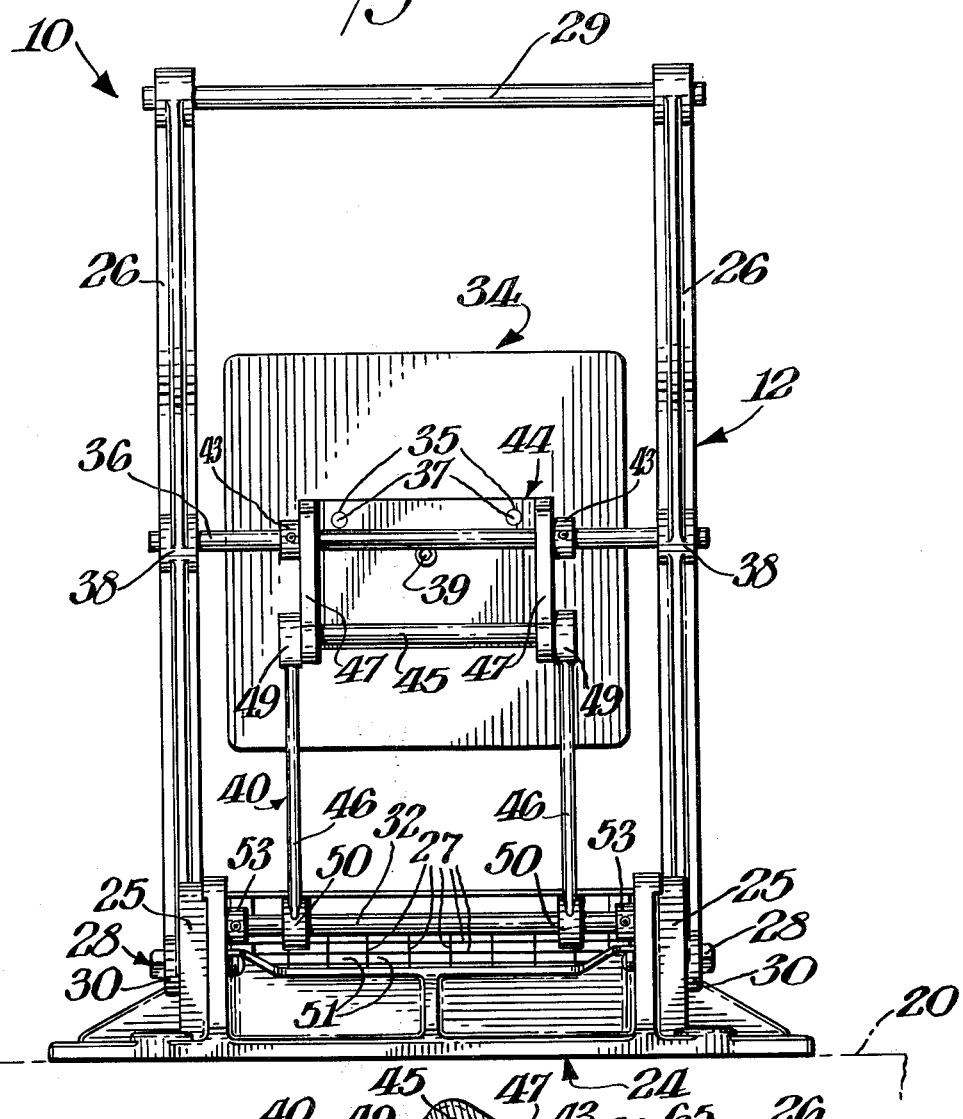
FIG. 3 is a rear elevational view of the device shown in FIGS. 1 and 2 in solid outline.

Pusher head 34 carries on its rear surface two alignment pins 35 (FIGS. 3 and 5) that are received in alignment holes 37 of U-shaped lever bracket 44 to insure proper alignment of fingers 42 for entrance through the spaces between the blade arrays 26. A bolt 39 completes final attachment of pusher head 34 to lever bracket 44.

Tilting linkage 40 connects pusher head 34 and attached U-shaped lever bracket 44, the latter pivotally receiving shaft 36, to frame extensions 25 by tilting bars 46.

Tilting bars 46 are pivotally attached at their upper ends by shaft 45 that passes through arms 47 of U-shaped lever bracket 44 and also passes through bearing collars 49 of bars 46. Those bars are pivotally attached at their lower ends by shaft 32 that passes through bearing collars 50 of bars 46 and through frame extensions 25.

Figure 5:
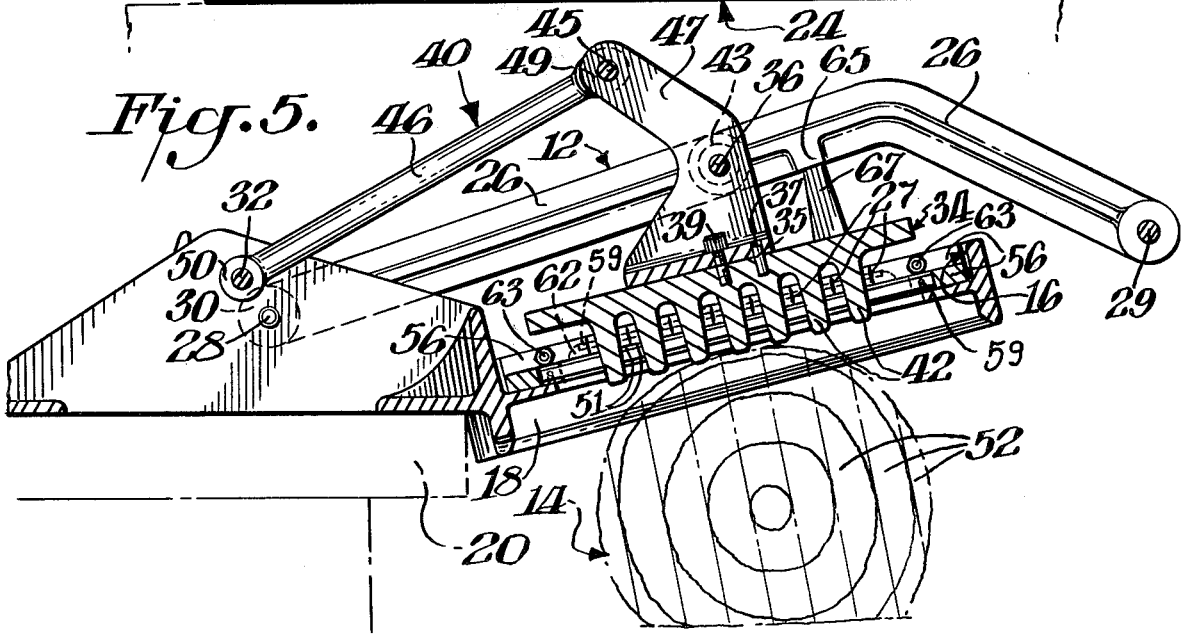
FIG. 5 is a cross-sectional side elevation view taken through FIG. 4 along the line 5—5 but showing the pusher and handle assembly in the fully lowered position with a chopped and shredded object in phantom outline below it.
Figures 4, 6:
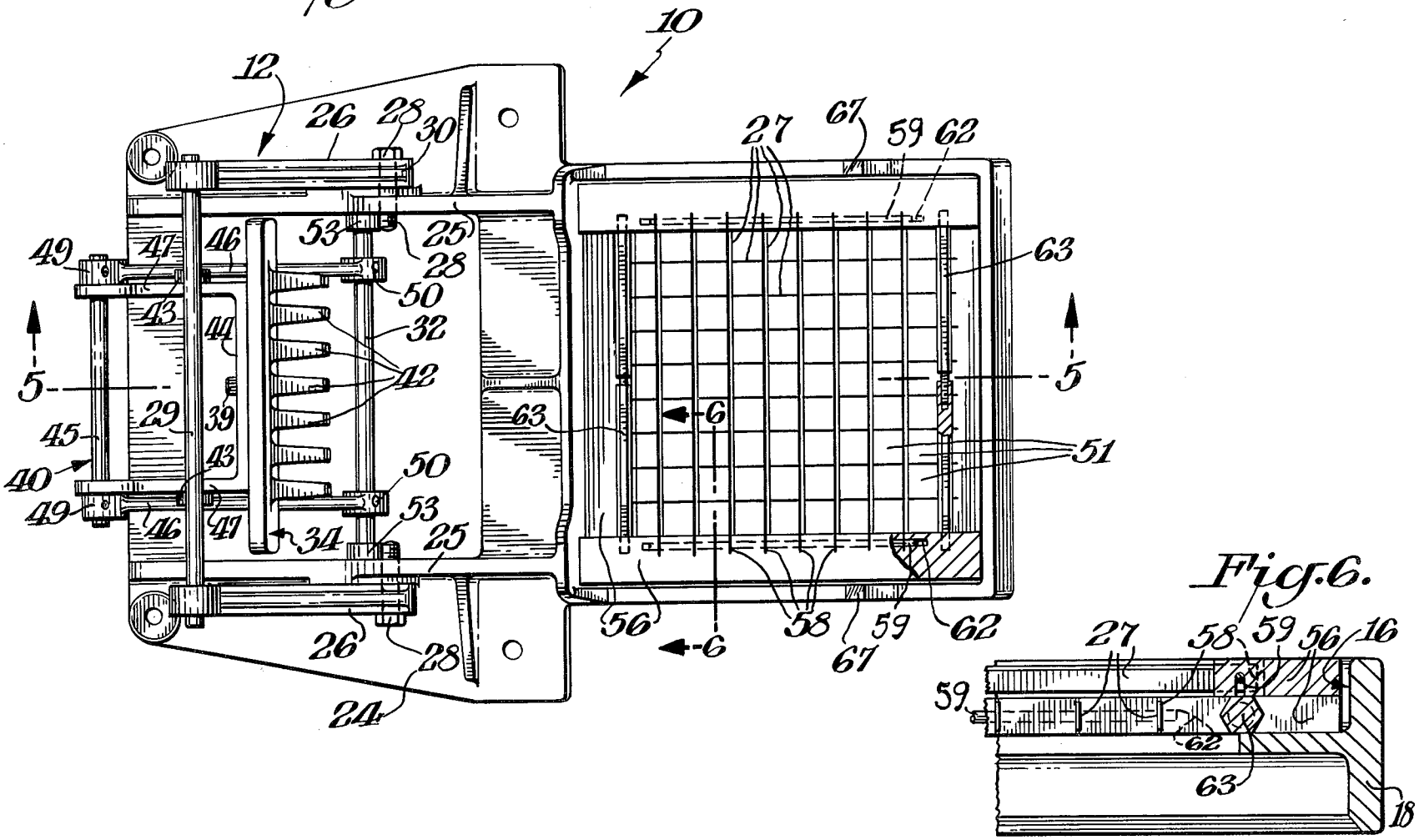
FIG. 4 is a top plan view of the chopper and shredder shown in FIGS. 1 and 2 in the fully opened position.
FIG. 6 is a cross-sectional view taken through FIG. 5 along the line 6—6.

Fingers 42 on pusher head 34 are easily adjusted and positioned horizontally relative to the blade openings 51 as shown in FIGS. 4 and 5, by collars 43 and 53 secured on shafts 36 and 32 respectively. The complete function of the tilting linkage 40 is later described.

FIG. 5 shows pusher fingers 42 passing between spaced blades 27 and discharging shredded and chopped pieces 52 of object 14 through blades 26 into bin or container 54 shown in FIG. 1. In the fully closed position shown in FIG. 5, fingers 42 are disposed directly and cleanly through spaces 51 between blades 27 which are arranged in a rectangular grid. For this purpose rotational shaft 32 connects lower end of tilting bar 46 to mounting frame 25 so that it is disposed slightly above and further from blades 27 than rotational support means 28 connecting the bottoms of handle struts 26 to frame extensions 25. FIG. 4 shows two sets of parallel blades 27 disposed within frame section 16. As shown in detail in FIGS. 5–6, an upper set of parallel blades 27 is tensioned between side bars 56 with their ends inserted in slots 58 spaced along side bars 56. Rods 59 in undercut slots 62 in bars 56 pass through holes in the ends of blades 26 to hold them in position. Turnbuckle screws 63 react between bars 56 to push them apart and thus tension blades 27 between them in a rigid array. A lower set of blades 27 between a similar pair of bars 56, but at right angles to upper blades 27 are also disposed in frame section 16 to provide a rectangular grid of blades. Only one set of blades may be used in either orientation if item 14 is only to be cut into strips.

The intermediate phantom position of handle 12 in FIG. 1 illustrates how fingers 42 are rotated with pusher head 34 by tilting linkage 40 to dispose fingers 42 more directly down into head 14. This applies the original chopping force more directly into head 14, which more effectively utilizes it and conserves energy. FIG. 1 also shows how blade frame 16 is tilted upwardly away from mounting section 24 away from the horizontal at an angle of approximately 15° to cooperate with the more effective direction of force into it by pusher head 54.

FIG. 5 shows how pusher fingers 42 are disposed at the end of the stroke more in line with and cleanly through the spaces 51 between blades 27. Such is also accomplished by the aforementioned tilting linkage 40 and abutting stops 65 and 67 on handle struts 26 and frame 18 respectively.

Figure 7:
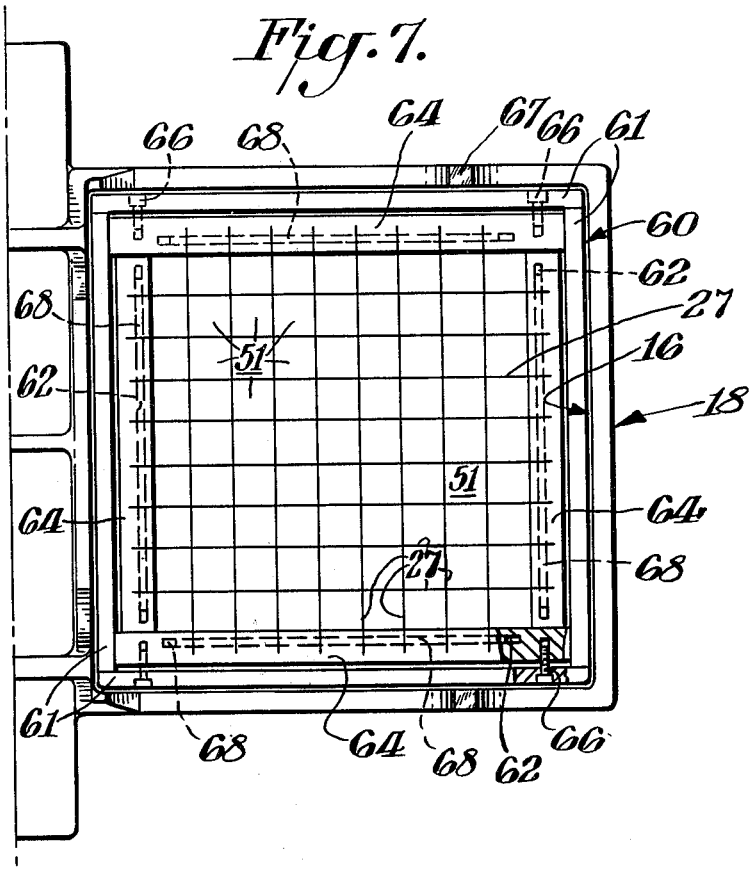
FIG. 7 is a top plan view of the blade mounting section and blades of the chopping device shown in FIGS. 1–6 with a slightly different form of blade-holding frame.

FIG. 7 shows an alternate frame and blade mounting in blade supporting section 16 by frame 60 having a rigid rectangular set of four sides 61 between which are mounted tensioning bars 64 by retracting screws 66 which apply tension to the ends of blades 27 through rods 68 in holes in the end of blades 27 and their retention in undercut slots 62 in bar 64. Blade tensioning arrangement in frame 60 is similar to that described in FIGS. 4–7 of U.S. Pat. No. 3,605,839.

The major portion of device 10 is made of aluminum in either cast or extruded form. Blades 27 are, however, advantageously made of sharpened strips of stainless steel approximately 0.025" thick and ⅜" wide. The outer frame assembly or blade assembly 60 is also made of stainless steel for strength and stiffness. The machined portions of the device 10 and hardware are advantageously made of stainless steel.

Figure 8:
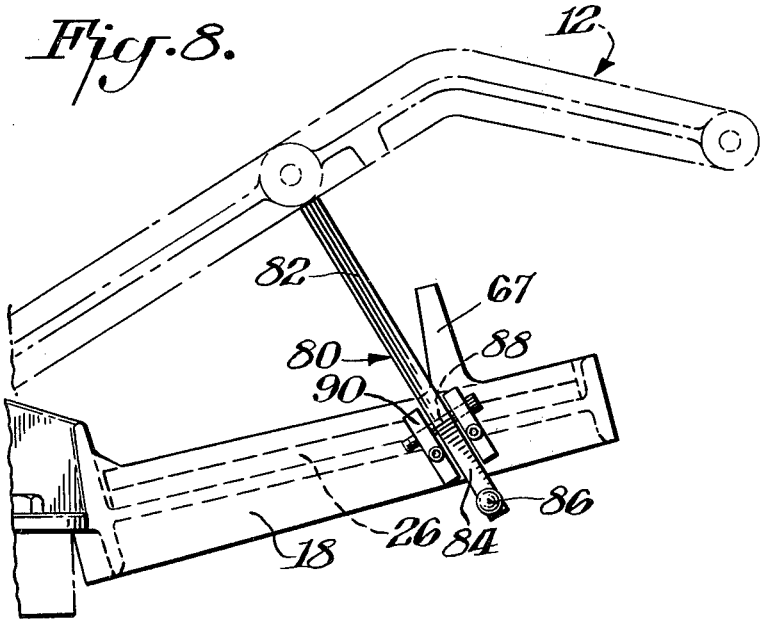
FIG. 8 is a front elevational view of a hand-operated safety latch for use in conjunction with this invention.
Figure 9:
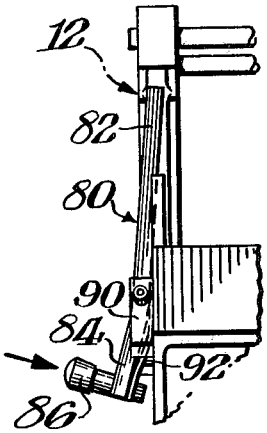
FIG. 9 is an end elevational view of the safety latch shown in FIG. 8.

FIGS. 8 and 9 show safety latch assembly 80 attached to frame 18 adjacent blade supporting section 16 by bracket 90. Safety latch assembly 80 includes a bent arm having an upper arm 82 slightly offset at an angle from lower arm 84. The joined arms 82 and 84 are pivoted to bracket 90 on pivot shaft 88 through their junction. Leaf spring 92 reacting between frame 18 and lower arm 84 biases upper arm 82 inwardly in the path of handle strut 26 to prevent it from being pushed completely down unless the operator places his free hand on release knob 86 to push arm 84 inwardly. Upper arm 82 therefore remains in the path of handle strut 86 unless the operator's free hand contacts knob 86. This insures that the operator cannot catch his free hand between pusher head 34 and blades 27. The various parts of safety latch assembly 80 are advantageously made of for example stainless steel, chrome plated brass or aluminum to suit the required service.

I claim:

1. In a chopping and shredding device for chopping and shredding objects such as lettuce heads by a finger-carrying pusher that pushes the heads down through a set of cutting blades, the improvement according to which the device has an integral elongated aluminum base frame one end of which has mounting means for securing to the edge of a table and the other end of which is an upwardly inclined blade-supporting section that projects beyond the table edge to which the frame is secured, the pusher is carried on an elongated operating handle one end of which is pivoted to a relatively low location on the mounting-means-carrying end of the frame spaced from the blade-supporting section so that a lettuce head will be received between that section and the pusher when the operating handle is pivoted away from that section but is not yet vertical, the pivoting of the handle permits it to pivot away beyond the vertical, a pusher tilting linkage is pivotally connected to the pusher and to the mounting-means-carrying end of the frame at a location above that to which the operating handle is pivoted, to adjust the tilt of the pusher as it pushes its fingers through the cutting blades, the tilting linkage being on the side of the handle remote from the blade-supporting section of the frame to help counterbalance the handle when it is pivoted away just beyond the vertical, and stop means is provided to keep the handle from pushing the pusher too far into the cutting blades.

2. The combination of claim 1 in which the handle is a pair of struts on either side of and behind the pusher, the free ends of the struts being angled toward the pusher and connected to each other by a bar, and the tilt linkage is pivoted about another bar connected between the struts.

3. The combination of claim 1 and further including a safety arm spring-urged into a position that blocks the handle movement just before it reaches the stop means, the safety arm having a manually-operated release that must be operated by one hand while the pusher is pushed by the handle with the other hand to push the lettuce head through the cutting blades and keep both hands from being cut by the cutter blades when the device is operated.

* * * * *